United States Patent [19]

Anderson

[11] 4,419,821

[45] Dec. 13, 1983

[54] SHEARING UNIT

[76] Inventor: Colin C. Anderson, 6 Montrose Pl., Beaumont, Adelaide, Australia

[21] Appl. No.: 293,637

[22] PCT Filed: Dec. 18, 1980

[86] PCT No.: PCT/AU80/00110

§ 371 Date: Aug. 18, 1981

§ 102(e) Date: Aug. 18, 1981

[87] PCT Pub. No.: WO81/01678

PCT Pub. Date: Jun. 25, 1981

[30] Foreign Application Priority Data

Dec. 18, 1979 [AU] Australia ..... PE1756

[51] Int. Cl.[3] ..... B26B 19/24

[52] U.S. Cl. ..... 30/276; 30/206; 30/40.1

[58] Field of Search ..... 30/200, 205, 206, 207, 30/40.1, 32, 276; 51/285

[56] References Cited

U.S. PATENT DOCUMENTS

| | | | |
|---|---|---|---|
| 181,692 | 8/1876 | Lhernault | 30/206 X |
| 194,794 | 9/1877 | Wightman | 30/276 |
| 199,243 | 1/1878 | Wightman | 30/276 |
| 430,669 | 6/1890 | McDonald | 30/276 |
| 4,110,905 | 9/1978 | Strijker | 30/40.1 X |

FOREIGN PATENT DOCUMENTS

| | | | |
|---|---|---|---|
| 1209022 | 1/1966 | Fed. Rep. of Germany | 30/40.1 |

*Primary Examiner*—Jimmy C. Peters

*Attorney, Agent, or Firm*—Cushman, Darby & Cushman

[57] ABSTRACT

A shearing unit for sheep and removing wool from a pelt by an endless or rotary cutter having a serrated cutting edge to operate at high speed. The endless belt cutting blade (1) is supported by a frame (3) with a comb (4) to maintain distance between the cutting blade (1) and the skin (5).

7 Claims, 6 Drawing Figures

FIG. 4
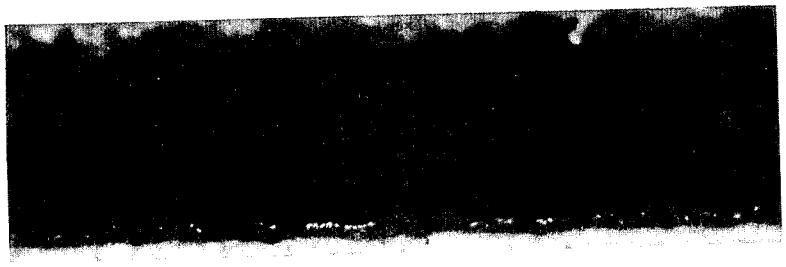
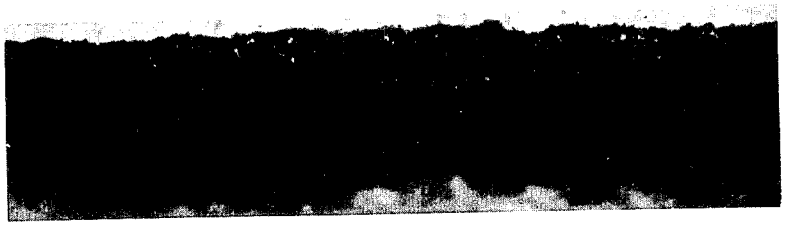
FIG. 5

SHEARING UNIT

This invention relates to an improved shearing unit, and more particularly to a shearing unit which includes an improved cutter for shearing the wool off a sheep.

BACKGROUND OF THE INVENTION

Conventionally shearing is carried out manually by using a hand piece which includes a cutter having cutting teeth moving over a stationary comb, the teeth oscillating or reciprocating back and forth over the teeth of the comb.

Work has been carried out for the mechanised shearing of sheep, these either being fully or partially mechanised but as far as is known, these all include a shearing mechanism or head which includes a similar form of reciprocating cutter.

The inherent disadvantages of these known cutters are well known, such as the mechanism required to convert the rotary motion into the reciprocating, motion, noise, and the need to frequently sharpen both the cutter and the comb.

Also due to the form of cutter and comb a considerable force is required in order for the fingers of the comb to penetrate the wool so that the cutter itself can cut the wool by acting with a scissor type action between the edges of the cutter blade and the fingers of the comb.

Attempts have been made to develop a non-reciprocating cutter by utilizing a sharpened blade which continuously moves in one direction and which may not need to co-operate with a stationary comb. However these have not been entirely successful due apparently to the fact that the sharpened and honed edge quickly becomes dulled and blunt, and also that if any rate of movement of the cutter through the wool is attempted, then the wool is not cut but is laid down beneath the cutter.

In U.S. Pat. No. 3,535,744 there is disclosed an apparatus and method for severing fleece from a sheep pelt, and which uses an endless belt knife in order to sever the fleece from the pelt. This endless belt knife is honed to a sharp edge, and the knife belt is continuously sharpened by grinding wheels rotated on a lower run of the knife belt, this knife belt being sharpened both sides by the pair of grinding wheels.

It is an object of this invention to provide a continuous or uni-directional cutter suitable for the shearing and cutting of wool and which cutter does not have to be continuously sharpened.

BRIEF STATEMENT OF THE INVENTION

Thus there is provided according to this invention a shearing unit having a cutting head, the cutting head having a cutting blade continuously moving in one direction, the edge of the blade having a serrated or serrulate edge whereby these serrations grip and cut the fibres of the wool.

The cutting blade can either be a hand piece having a disc to rotate at a high speed or an endless belt form of blade with the cutting surface or edge of the disc or belt being provided with the finely serrated or serrulate edge to mechanically shear a sheep on a shearing cradle.

BRIEF DESCRIPTION OF THE DRAWINGS

FIG. 4 shows a photograph of a blade produced with a stone 35 grit, FIG. 5 shows a blade ground with a 60 grit stone and, FIG. 6 shows a rotary form of cutter

A DESCRIPTION OF THE PREFERRED EMBODIMENT

Figure 1:
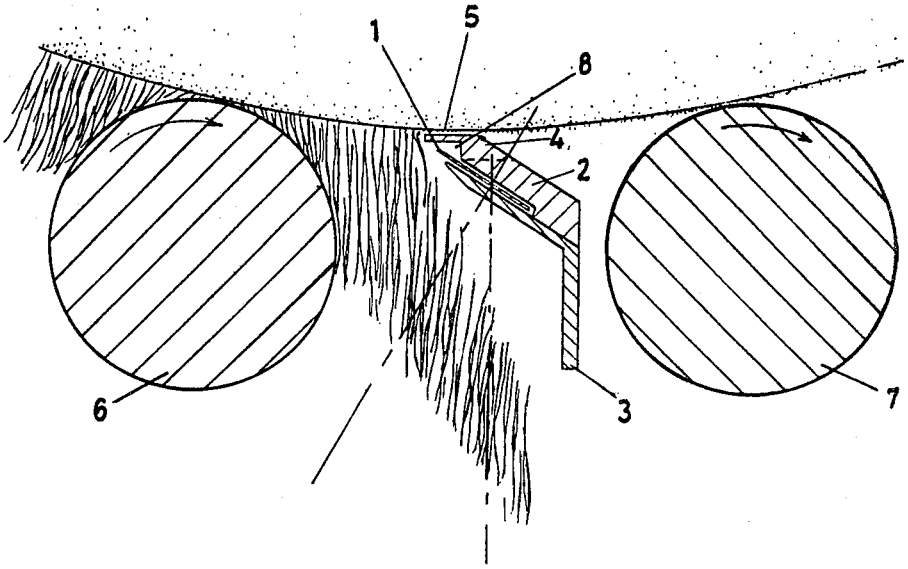
FIG. 1 shows an endless belt blade shearing the fleece from the body of a sheep.

The wool industry throughout the world has been seeking alternative methods of severing wool fibres and to date it has been felt from experience that the use of a band cutter or rotary cutter was a concept which was not technically feasible as a severance method.

A smooth cutting edge, such as a knife or razor edge depends for its cutting effect on the pressure that can be applied between the fibre and the cutting blade. This pressure or force can be increased by the introduction of friction from longitudinal movement of the blade. However with a smooth edge these forces are limited depending on the resistance of the fibres to the pressure applied and this decreased away from the root of the fibre because of the cantilever effect.

In shaving the blade edge is applied as close as possible to the root of the fibre so that the forces necessary to sever the fibres can be applied.

However it is not practical to shave sheep. A minimum length of residual fibre is required for protection against the elements. The cantilever effect introduced reduces the effective pressure that can be applied to the cutting edge making it practically ineffective.

The introduction of the sharp but serrated edge introduces an entirely new principle. Only pressure sufficient to engage or enter the fibres into the serrations is required. Having entered the serrations they are then subjected to the chopping or cutting impact applied by the serrations of the fast moving blade and the severance of the fibres is now mostly effected in the direction of the movement of the blade. The contact is no longer a gentle pressure but rather the impact of a chopping effect by the serrated edges on the fibres themselves.

While any developmental work up to date has apparently been influenced by the traditional method of shearing based on conventional hand shear blades or reciprocating blades each of which relay on a scissor action, the attempts which have been made to adapt a smooth honed cutting edge to a free cutting method results in the fibre laying down in front of the blade when an acceptable rate of cutting is attempted. A honed blade relies on the sharpness of the edge to sever the fibre when drawn across the fibres.

Thus the work by the inventor has established a new and efficient method of severance, in that a sharp and rough or serrated edge moving at a sufficiently high speed cutting close to the root of the fibre will sever the fibres with no observable displacement. This cutting edge is created by using a relatively rough grinding stone to produce sharp serrations that engage the fibres which are then subject to the impact of the speed of the moving blade.

In effect the cutting action is in the direction of the movement of the blade along its length rather than perpendicular to it. Within practical limits the cutting efficiency of the blade is related to its speed of movement.

In moving the blade into the fleece to engage the fibres some pressure must be applied which must result in some laying over of the fibres. The amount of pressure that must be applied is dependent on maintaining the efficiency of the cutting edge and the rate of cutting. The resulting angle of laying over is then a function of where this pressure is applied, it will be less when cutting close to the skin and greater when cutting at a distance therefrom.

FIG. 1 shows one example of a shearing unit which can be utilised to shear a major portion of the fleece a sheep. The Fig. shows one form of shearing unit in which the cutting element is an endless blade 1 guided in a guide track 2 mounted on a support frame 3.

The guide track is also provided with a short comb 4 which protrudes with its fingers only slightly ahead of the cutting blade. The main purpose of the comb is to create a distance between the cutting blade and the skin of the sheep 5 to leave the required length of wool on the body of the sheep.

The shearing unit is also provided with a pair of driven rollers 6 and 7 which assist in moving the sheep around and rotating the sheep, and roller 7 could be driven at a slightly higher speed than roller 6 so that the skin of the sheep is maintained in a taut condition.

There is a space provided in the guide track immediately behind the cutting edge this space 8 being provided to prevent the fibres being drawn between the teeth of the comb and the cutting blade.

The blade is inclined to the normal to the body of the sheep, and as shown this could be in the vicinity of 15 degrees.

The form of shearing cradle as shown in my earlier Australian Patent Application No. 53982/79 can have incorporated therein the cutting blade of the present invention, with the sheep restrained by means as shown in my Australian Pat. No. 501826. Hence it is merely necessary for the shearer to clamp the sheep in position, and skirt the fleece by shearing the legs, belly and head. The shearer then opens the fleece by a shearing cut to present a face of the wool along the side of the sheep up to the shoulder. This opening cut is then presented to the knife and by turning and rolling the sheep, the fleece is shorn from the sheep. Hence up to 80% of the sheep is shorn mechanically.

Figure 2:
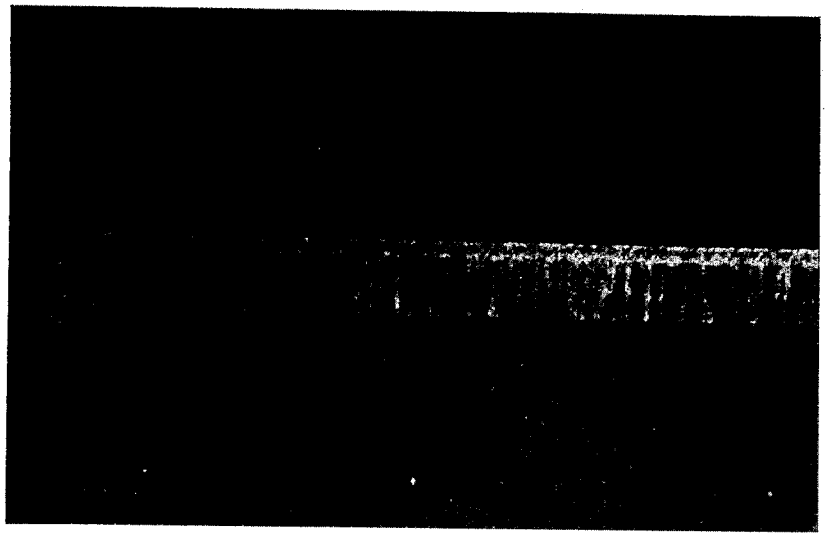
FIG. 2 shows the edge of a razor blade magnified ten times.

As shown in FIG. 2 there is illustrated the edge of a typical razor blade which is honed to a sharp edge this photograph being taken at a magnification 10 times.

Figure 3:
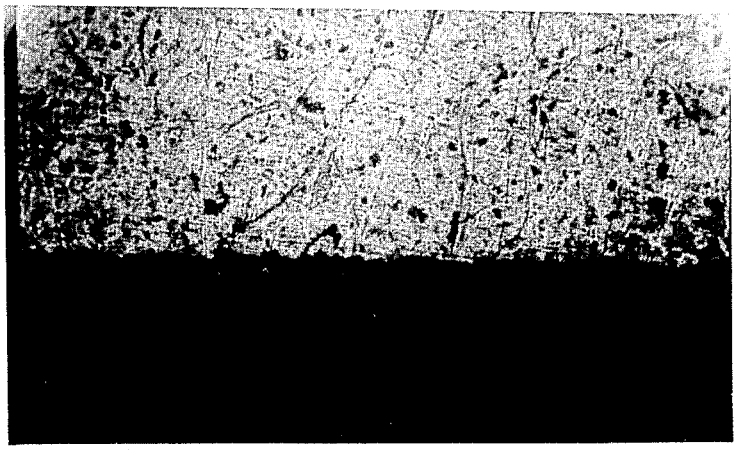
FIG. 3 shows a blade which is produced by a grinding stone having a rating of 46 grit.

FIG. 3 shows a cutting blade which has been provided with an edge caused by a grinding stone having a grit of 46. For comparisons FIG. 4 shows an edge produced by a 35 grit stone while FIG. 5 shows an edge produced by a 60 grit stone.

It will be seen that these produce an edge having a roughened and serrated edge these serrations being such that the roughness can be readily felt by drawing a finger nail over the edge of the cutting blade.

For convenience the roughness of the blade can best be defined as that produced by the range of grits, and it has been found that the desired serrations can be provided by grits having the range of 30 to 120 grit.

Where reference is made to "grit" this is the standard approved by the Abrasive Grain Association and Grinding Wheel Manufacturers Association.

As shown in FIG. 1 the angle of the blade to the normal of the cutting surface is effected by various factors. This includes the required clearance behind the cutting edge for the free passage of the residual fibres, and to compensate for the angle of laying over of the fibres in order to maintain a satisfactory angle of presentation of the cutting edge to the fibres.

In order to meet the above requirements it is necessary to vary this angle for different operational conditions, whether the wool is of a fine wool or a coarser wool.

The speed of the blade effects the rate at which the fibres are satisfactorily severed. That is the rate of feed of the fibres to the blade can be increased with increased blade speed but it is to be noted that there is obviously an operating practical limit.

The effect of these relative speeds can be observed by studying the length of the residual fibre. The length of the residual fibre increased with increased feed of fibres that is an increase laying over of the fibres in front of the blade.

However by increasing the speed of the blade this increases the impact effect of the serrations on contact with the fibres. It has been found that at speeds of the order of 1,500 meters per minute the efficiency of the cutting operation is greatly improved over speeds of 1,000 meters per minute and it is felt that an operational limit of about 3,000 meters per minute would be achieved.

It is necessary to maintain an efficient cutting edge on the blade and this will depend on various factors, (1) the gauge or thickness of the fibres (2) the density of the fibres and (3) foreign material (sand etc. present in the fleece).

Under a given set of conditions of operation the efficiency of the cutting edge can be observed by comparing the length of the residual fibres that exist for a known speed of blade, height of cut and angle of presentation. The remaining variable factor is the sharpness of the serrations, as these wear or become dulled the residual fibres will increase in length.

However it is possible to treat the edge of the blade with a selected stone during the process of removal to maintain its cutting efficiency.

The serrations are produced by the grits moving across the cutting edge. The speed of the blade and the peripheral speed of the stone affect the angle of presentation of the stone to the blade to produce the desired angle of serrations to engage the fibres.

Grinding stones may vary in hardness and grit size and the cutting effect can vary with variations in each. The cutting effect to produce the serrations required also varies with the hardness of the blade used. For a given set of circumstances a stone of a particular grit size and hardness or softness is selected to produce the desired optimum roughness of the serration.

Figure 6:
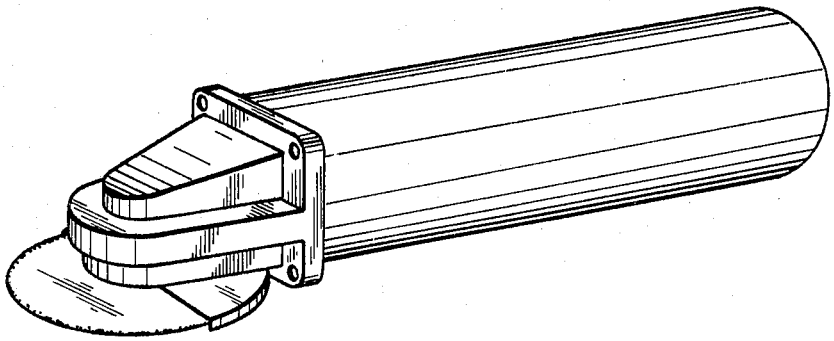

It will be seen that with the present invention there is provided a cutting unit which will effectively cut and shear the wool from a sheep with the cutting unit having a continuous direction of movement whether this be a rotary unit as illustrated in FIG. 6 or an endless blade type shown in FIG. 1 the type in FIG. 6 being useful as a hand piece in which the forward force to present the cutter blade to the wool is reduced due to the fact that there are no teeth or comb-like fingers to be pushed through the wool before the cutter blade acts on the wool to sever the wool, the small comblike fingers do not present an appreciable force to the forward movement.

I claim:

1. A shearing unit for shearing wool from a pelt or skin of a sheep, said unit comprising a head having an endless cutting blade, means to drive said endless cutting blade, and a comb to space said blade from the pelt or skin, characterised in that said comb essentially provides no support or restraint on the fibres of the wool and said endless cutting blade is provided with a serrated cutting edge, the serrations being of a size corresponding to that produced by a grinding stone selected within the range of 30 to 120 grit, whereby at high cutting speeds said serrated edge cuts the wool by the serrations impacting on the unsupported and unrestrained fibres of the wool.

2. A shearing unit as defined in claim 1 characterised in that the serrations correspond to a size produced by a 60 grit stone.

3. A shearing unit as defined in claim 1 characterised in that the endless cutting blade operates at a linear speed of 500 to 3,000 meters per minute.

4. A shearing unit as defined in claim 1 characterised in that the endless cutting blade operates at a linear speed of 1,500 meters per minute.

5. A shearing unit as defined in claim 1 characterised in that said cutting blade is a rotary cutter.

6. A shearing unit as defined in claim 1 characterised in that said cutting blade is an endless belt cutter.

7. A shearing unit as defined in claim 1 characterised by a space behind said cutting blade to prevent fibres being drawn along the blade.

* * * * *